US006260455B1

(12) United States Patent
Ferguson

(10) Patent No.: US 6,260,455 B1
(45) Date of Patent: Jul. 17, 2001

(54) MOTOR VEHICLE ACCESS DEVICE

(75) Inventor: Roger K Ferguson, Johannesburg (ZA)

(73) Assignee: Twisto CC, Johannesburg (ZA)

( * ) Notice: Subject to any disclaimer, the term of this patent is extended or adjusted under 35 U.S.C. 154(b) by 0 days.

(21) Appl. No.: 09/516,585

(22) Filed: Mar. 1, 2000

(30) Foreign Application Priority Data

Mar. 1, 1999 (ZA) ..... 98/10917

(51) Int. Cl.[7] ..... B25B 27/00
(52) U.S. Cl. ..... 81/488
(58) Field of Search ..... 81/488

(56) References Cited

U.S. PATENT DOCUMENTS 4,561,271 * 12/1985 Scharboneau .
5,440,954 * 8/1995 Stevens .
5,642,648 * 7/1997 Wendt et al. .
5,937,713 * 8/1999 Walters .

* cited by examiner

*Primary Examiner*—Timothy V. Eley
*Assistant Examiner*—Willie Berry, Jr.
(74) *Attorney, Agent, or Firm*—Banner & Witcoff, Ltd.

(57) ABSTRACT

The invention concerns a vehicle access device comprising a pair of sheathed elongated filaments which may have a common sheath, one filament acting in use to flex the other to enable the latter to engage a vehicle door lock release knob, the sheath or sheaths being inherently resiliently flexible.

10 Claims, 2 Drawing Sheets

MOTOR VEHICLE ACCESS DEVICE

FIELD OF THE INVENTION

This invention relates to a device to assist in gaining access to a locked vehicle.

BACKGROUND TO THE INVENTION

Many vehicles are unintentionally locked with the keys inside the vehicle or keys are lost with the vehicle locked. Motor vehicle door locks are becoming more and more sophisticated to prevent theft. This sophistication however makes it difficult for legitimate access to be obtained when necessary under circumstances as set out above or at accident scenes.

OBJECT OF THE INVENTION

It is the object of this invention to provide a means which will facilitate the opening of a locked vehicle door for which a key is not available.

SUMMARY OF THE INVENTION

In accordance with this invention there is provided a vehicle access device comprising a pair of sheathed elongated filaments having independant controls at one end, a first filament having an end opposite the controls with a clamping device secured thereto and the end extensible and retractable relative to the end of its sheath and the second filament retractable in its sheath to provide a bend in the sheath for the first filament at a predetermined distance from the end remote from the controls.

Further features of this invention provide for the filaments to share a common sheath, for the first filament to have a contractable clamping device at the end thereof remote from the controls and for the contractable device to be interchangeable with different kinds of clamping devices.

The invention also provides for the first filament to be a cable and for the control to be by means of a knob on the end of the cable enabling the cable to be retracted through a hollow boss provided on the end of the sheath and for a clamp to be provided operable between the cable and the boss. The invention also provides for there to be a rigid connecting piece between the filament and the knob extending through the boss.

Still further features of this invention provide for the second filament to be made of synthetic resin material such as nylon and for the control to be a rotatable anchor within the boss and for the filament to be anchored in a first collar within the sheath adjacent the end remote from the controls, to pass through a second collar spaced from the first collar towards the controls with the second cable extending outside the wall of the sheath between the collars.

The term "Bowden-type cable" is used in this specification to describe the type of control which has a sheath around a filament the sheath being anchorable at each end so that the filament within the sheath can be moved relative to at least one end of the sheath to enable the other end of the filament to exercise a desired movement of a component secured to that end.

BRIEF DESCRIPTION OF THE DRAWINGS

An example of this invention is described below with reference to the accompanying drawings in which.

DETAILED DESCRIPTION WITH REFERENCE TO THE DRAWINGS

As shown the device (1) for gaining access to a motor vehicle comprises a pair of Bowden-type cables (2) and (3) housed in a single sheath (4).

Figure 2:
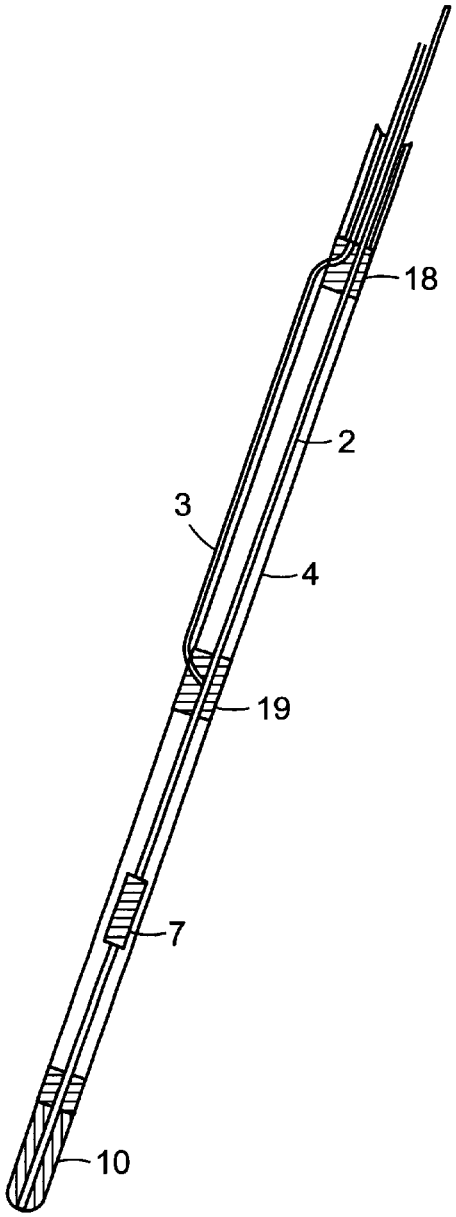
FIG. 2 a similar view of part of the device ready for use.

With the device in the condition shown in FIG. 2 the end can be inserted over the edge of a door window between the glass and the rubber or indoor peripheral seal into the interior of the vehicle.

The first cable (2) is a suitable braided cable and has a control knob (5) at one end. It has a rigid preferably stainless steel wire end piece (5A) which extends through a hollow boss (6) at the adjacent end of the sheath. This is connected to the cable (2) which extends through the length of the sheath (4) to a tip (7) at the other end of the sheath (4).

The tip (7) provides a hole and slot (8) to capture the end of a short length of separate cable (9) which extends through a removable plug (10). The end (11) of the cable length (9) is anchored to the plug (10) as shown.

Slideable on the steel wire end piece (5A) between the control knob (5) and the end of sheath (4) is fitted a clamp (12). This clamp is in the form of a compressible member which is a sliding fit on the steel wire end piece (5A) and is insertable into the tapered end of the hole in the boss (6) to contract around the steel wire end piece (5A) and prevent relative movement between the end piece and the boss (6). This will fix the position of the separate cable (9) for the purpose described below.

Figure 3:
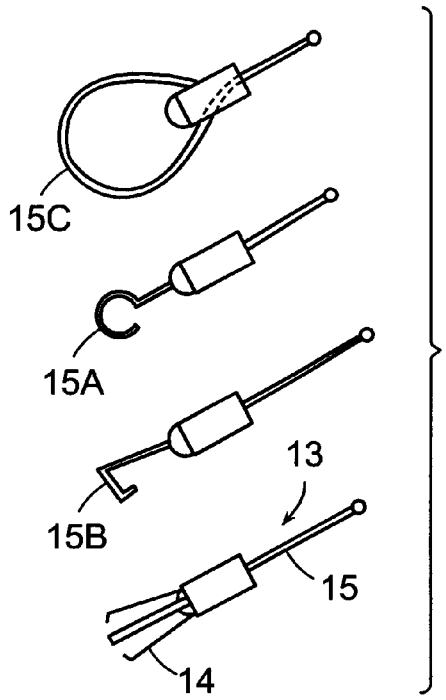
FIG. 3 shows details of interchangeable first cable ends.

The tip (7) may be replaced by other tips (13) illustrated in FIG. 3. Tip (13) may have claws (14) which are biased to the open position and can be contracted by pulling on the end of the separate cable (15). Alternative forms of clamping devices in the forms of hooks (15A) or (15B) or small loops (15C) are also illustrated in FIG. 3.

The boss (6) has a rotatable component (16) located therein and the end of the second filament (3) has one end anchored to the component (16). This enables the filament (3) to be retracted into the sheath (4) by rotating the component (16) within the boss (6). This filament is preferably of suitable synthetic resin material such as nylon for example.

Figure 1:
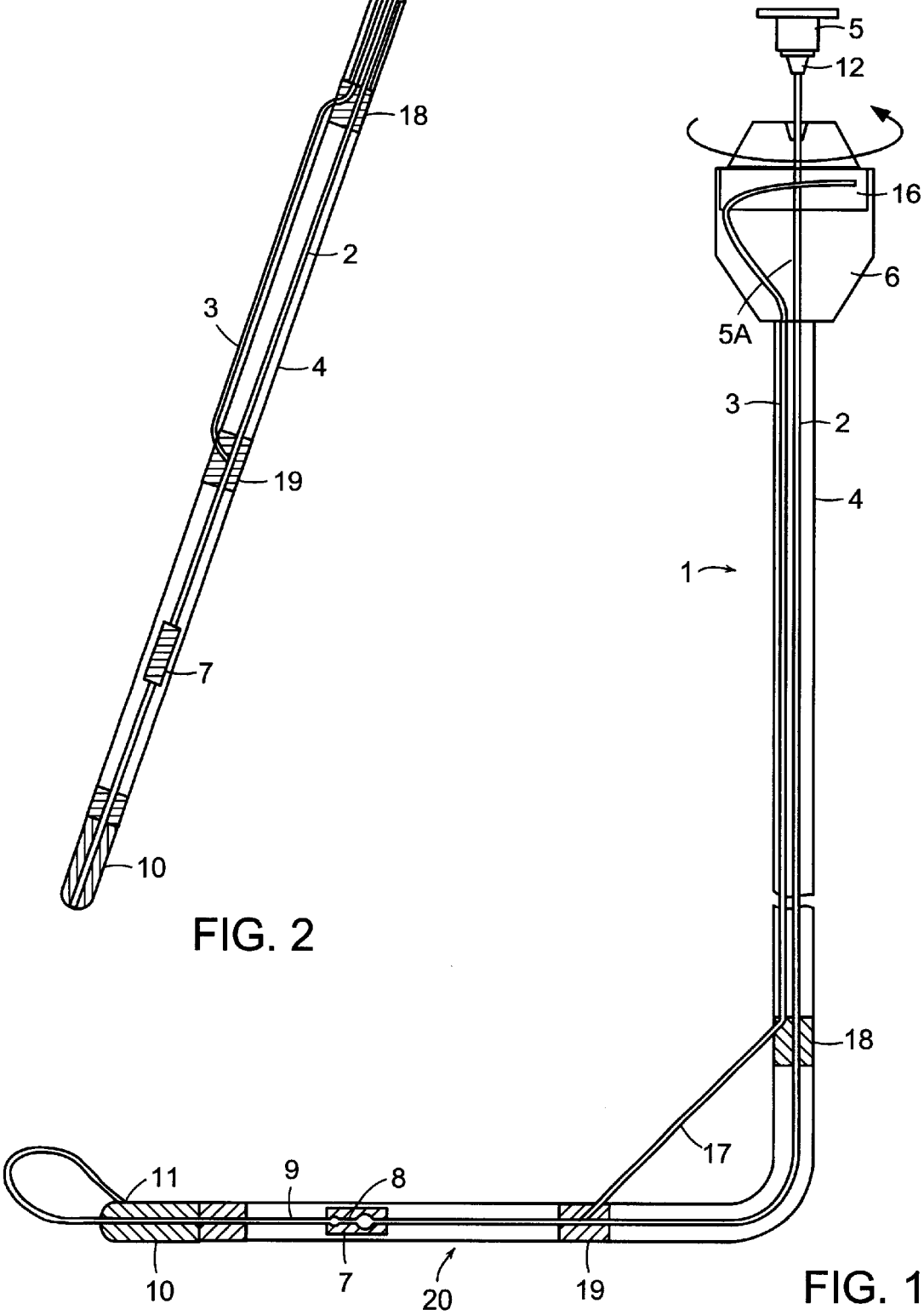
FIG. 1 is a diagrammatic sectional view of the device.

The other end (17) of filament (3) passes through a collar (18) and through the wall of the sheath (4). The end of this cable is anchored to a second collar (19) fixed in the sheath (4) and spaced apart from collar (18) towards the tip end of the sheath (4). The distance between the two collars and the distance between collar (18) and the control end of the sheath (4) determine the length of the leg (20) of the device as indicated in FIG. 1. This leg (20) is formed by retracting the second filament (3) into the boss (6) and causing the sheath (4) to flex as illustrated. The material from which the sheath is made is resiliently flexible to ensure that the sheath (4) will resume its original straight shape when the filament (3) is released and allowed to return to its original position.

In use when it is desired to open a locked vehicle the first thing done is to choose the appropriate tip to best grip the release knob of the door lock. Having secured the tip in position in the end of the sheath (4) remote from the boss (6), this end is inserted into the vehicle around the window glass within the window seal. The claw or cable will be retracted while this is done.

The end of the cable is manoeuvred into a position adjacent the door lock knob and then the claw or other clamping device extended from the tip. The second cable is then retracted into the boss (6) to form the leg (20).

With the device in this condition it is a simple matter to manipulate the clamping device at the end of the sheath (4) over the door lock knob. Pulling on the control knob (5) of cable (2) will trap the door lock knob at the tip and this entrapment can be secured by securing the clamp (12) in the boss (6).

The second filament (3) can then be released from the boss (6) and retraction of the sheath (4) from the vehicle will pull the door lock knob into the released position and access to the vehicle is obtained.

Some automobiles are today manufactured without the lock release knob referred to above. These vehicles have pivoted handles which must be swung about vertical pivots rearwardly into the body space of the car.

The invention provides an accessory to the device above described which can be used to gain access to vehicles of this kind.

Figure 4:
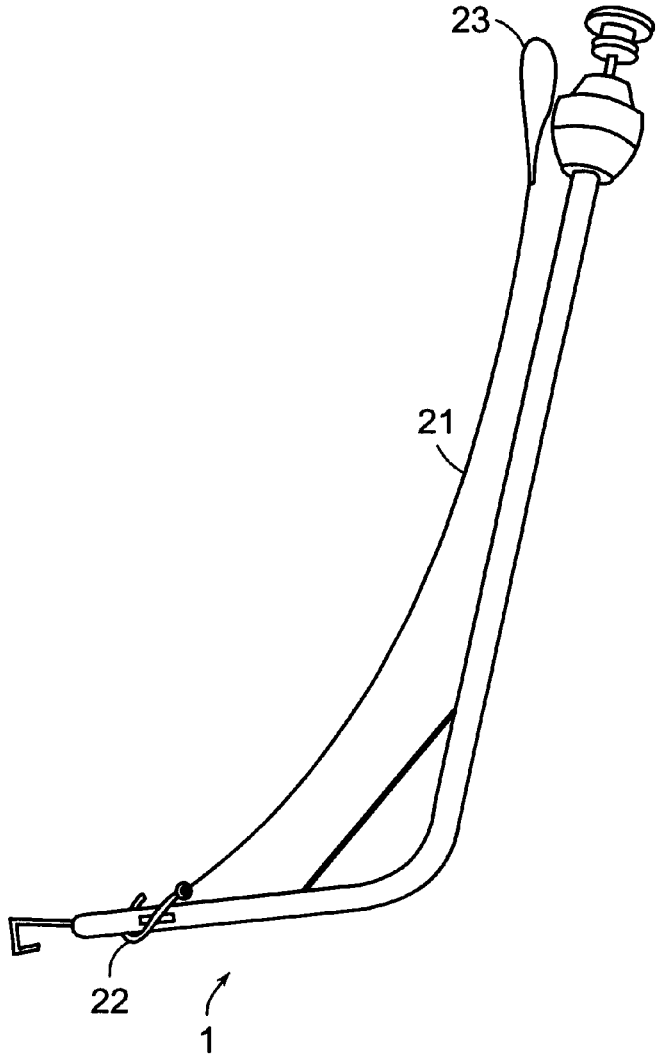
FIG. 4 shows the use of an accessory to the device.

Such an accessory is diagrammatically shown in FIG. 4 in use.

The accessory consists of a length of nylon or similar filament (21) having a rigid hook (22) attached to one end. This hook is taped or otherwise releasably attached near the end of the device (1) remote from the controls. The other end is provided with a hand hold in the form of a loop (23). This enables the accessory to be used to control the location of the clamping device to a limited degree other than by means of the filament (3).

The accessory is used by initially introducing the device and accessory together into the car as above described. The loop end end of the accessory is then moved away from the device along the length of the window until it has swung the tip of the device along an arc which will bring the tip in line with the handle. The controls can then be manipulated so that clamping device in the form of the hook (15C) can be engaged with the door handle. Because the controls are behind the hook attached to the handle with respect to the vehicle door the tip can be made to move into the car on a substantially horizontal plane and thus pull the handle to open the door.

The invention provides an effective easy to use device for obtaining access to a locked motor vehicle which will not result in damage to the vehicle.

What I claim as new and desire to secure by Letters Patent is:

1. A vehicle access device comprising a pair of sheathed elongated filaments having independent controls at one end, a first filament having an end opposite the controls fitted with a damping device and the opposite end extensible or retractable relative to its sheath and the second filament retractable from its sheath to provide a bend in the sheath for the first filament at a predetermined distance from the end of the device remote from the controls.

2. A device as claimed in claim 1 in which the first filament is a braided cable.

3. A device as claimed in claim 1 in which the first filament is a braided cable with a rigid end piece at the control end.

4. A device as claimed in claim 1 in which the first filament is a braided cable and the second filament a synthetic resin filament.

5. A vehicle access device as claimed in claim 1 in which the first and second filaments share a common sheath.

6. A vehicle access device as claimed in claim 1 in which the clamping device is interchangeable.

7. A device as claimed in claim 1 in which the first and second filaments share a common sheath and two collars are spaced apart and fixed within the sheath and the second filament extended outside the sheath between these collars and is fixed to the collar remote from the control end and passes through the other collar to its control end.

8. A vehicle access device comprising a pair of elongated filaments sharing a common sheath and each having a control at one end, a first filament having an end opposite the controls fitted with a clamping device and the opposite end extensible or retractable relative to its sheath and the second filament control consists of a hollow boss provided on the end of the sheath and a rotatable anchor within the boss to which the second filament is secured.

9. A device as claimed in claim 8 in which the sheath for the filaments is made of flexible resilient material.

10. A device as claimed in claim 8 in combination with an accessory in the form of a third filament one end of which carries a rigid hook securable to the sheath adjacent the end remote from the controls and the other with a hand hold.

* * * * *